United States Patent [19]

Boschung

[11] 4,222,044

[45] Sep. 9, 1980

[54] EARLY ICE-WARNING DEVICE

[75] Inventor: Marcel Boschung, Schmitten, Switzerland

[73] Assignee: Firma Marcel Boschung, Schmitten, Switzerland

[21] Appl. No.: 900,811

[22] Filed: Apr. 27, 1978

[30] Foreign Application Priority Data

May 4, 1977 [CH] Switzerland ..... 5583/77

[51] Int. Cl.[2] ..... G08B 21/00

[52] U.S. Cl. ..... 340/581; 340/580

[58] Field of Search ..... 340/581, 580

[56] References Cited

U.S. PATENT DOCUMENTS

| | | | |
|---|---|---|---|
| 2,849,701 | 8/1958 | Clark | 340/581 |
| 3,422,677 | 1/1969 | Lockwood | 340/581 |
| 3,596,264 | 7/1971 | Ciemochowski | 340/581 |
| 3,613,063 | 10/1971 | Ciemochowski | 390/581 |

FOREIGN PATENT DOCUMENTS

| | | |
|---|---|---|
| 2211699 | 7/1974 | France . |
| 560941 | 4/1975 | Switzerland . |

*Primary Examiner*—Glen R. Swann, III

*Attorney, Agent, or Firm*—Dann, Dorfman, Herrell and Skillman

[57] ABSTRACT

An early warning signal is produced when there is a danger of ice forming on a road surface by means of a device comprising a temperature sensor for determining the ambient temperature, a sensor unit for determining the temperature and moisture of the road surface, a heatable sensor unit having a heating element and a moisture-detecting gap, and comparators for comparing the voltages supplied by the temperature sensors and the moisture sensors with reference voltages, comprises in addition thereto a sensor unit having a further moisture-detection gap, one or more elements for alternately cooling or heating this further moisture-detection gap, and a temperature sensor for determining the temperature of this further moisture-detection gap, as well as signal generators generating signals in response to the output signals of the comparators for indicating whether the road surface is dry, wet, or icy. The early warning signal is reliably given in advance of actual ice-formation solely as a function of the road surface temperature and of the condition of the moisture sensors. The response thresholds of those comparators which are associated with the moisture sensors are preferably varied as a function of the road surface temperature in order to allow for the influence exerted on the freezing point by thawing agents spread on the road surface.

9 Claims, 13 Drawing Figures

EARLY ICE-WARNING DEVICE

FIELD OF THE INVENTION

This invention relates to devices for determining meteorological and surface conditions, and more particularly to a device for generating an early warning signal when there is a danger of ice forming on a road surface.

DESCRIPTION OF THE PRIOR ART

U.S. Pat. No. 3,596,264 discloses a device responsive to atmospheric influences which reports the danger of ice-formation in advance and indicates the actual formation of ice. This known device comprises a first sensor assembly having a temperature sensor for determining the ambient temperature and a sensor for determining the relative humidity; a second sensor assembly disposed in a surface, such as a road surface, having a temperature sensor for determining the surface temperature and two electrodes forming a detecting gap for determining the presence of either free water, frost, ice, or snow on the surface; a third sensor assembly which is similar to the second sensor assembly and comprises in addition a heating element for heating the detecting gap; and circuitry for evaluating the values determined by the three sensor assemblies. The circuitry contains a number of reference voltage circuits and the comparators. A first comparator is connected to the temperature sensor of the second sensor assembly and to a first reference voltage circuit which supplies a reference voltage corresponding to a surface temperature of 0° C. The first comparator generates an output signal when the surface temperature drops to 0° C. A second comparator is connected to the temperature sensors of the both the first and second sensor assemblies. The second comparator generates a signal when the surface temperature is about 2° C. lower than the ambient temperature. A third comparator is connected to the relative-humidity sensor and to a second reference voltage circuit which supplies a reference voltage corresponding to a relative humidity of about 90%. The third comparator generates an output signal when the relative humidity is greater than 90%. The outputs of the three comparators are connected to a gate circuit which produces an advance warning signal when all three of the comparators create output signals, i.e., when the ambient temperature drops to 0° C. or below, when the surface temperature is 2° C. lower than the ambient temperature, and when the relative humidity is more than 90%.

The advance warning signal produced in the foregoing manner is a true early warning if the road surface is dry before the occurrence of the weather conditions described. If the road surface is wet from the outset, the advance signal is produced too late, namely not until the road surface is already icy.

However, the formation of ice on road surfaces is not dependent upon the temperature and degree of moistness of the road surface alone. It also depends to a far greater extent upon thawing agents, such as salt, which are spread on the road surface. Devices have been proposed which take into account the presence of thawing agents by measuring and evaluating a change in electrical resistance as a function of the temperature for various concentrations of thawing agents. The disadvantage of such devices is that they cannot distinguish whether a certain resistance is caused by a little water combined with a large amount of thawing agent or a great deal of water combined with a little thawing agent. Accordingly, there is no sure advance indication as to whether a danger of ice-formation is really imminent or not. It may very well happen that the road surface slowly dries out at temperatures below 0° C., so that such a device registers an increase in resistance and consequently produces a false alarm.

BRIEF SUMMARY OF THE INVENTION

It is an object of the present invention to provide an improved early ice-warning device which does not possess the aforementioned shortcomings and which is capable of producing a signal which always warns far enough in advance in all kinds of weather.

These objects, as well as additional objects and advantages which will become apparent from the following detailed description and the appended drawings and claims, are accomplished by the present invention which, in one form, comprises a device for producing an early warning signal in anticipation of ice-formation on a road surface, of the type having ambient temperature sensing means, a first sensor unit comprising surface temperature sensing means and first moisture detector, a second sensor unit comprising second moisture detector and means for heating the second moisture detector, a first group of comparators associated with the temperature sensing means, a second group of comparators associated with the first and second moisture detector, means for generating reference voltages for the comparators, first signal means for generating a warning signal, second signal means for generating a signal when the road surface is wet, third signal means for generating a signal when ice has formed on the road surface, and means for actuating and deactuating the means for heating, the improvement comprising a third sensor unit comprising third moisture detector, means for determining the temperature of the third moisture detector, and alternate heating and cooling means; control means responsive to the temperature of the road surface, to the temperature of the third moisture detector, and to the output of the second signal means for powering the alternate heating and cooling means; and changeover means responsive to the temperature of the third moisture detector and to values measured by the first, second, and third moisture detector for changing over the mode of operation of the alternate heating and cooling means.

BRIEF DESCRIPTION OF THE DRAWING

A preferred embodiment of the invention will now be described in detail with reference to the accompanying drawings, in which.

DESCRIPTION OF THE PREFERRED EMBODIMENT

Figure 1:
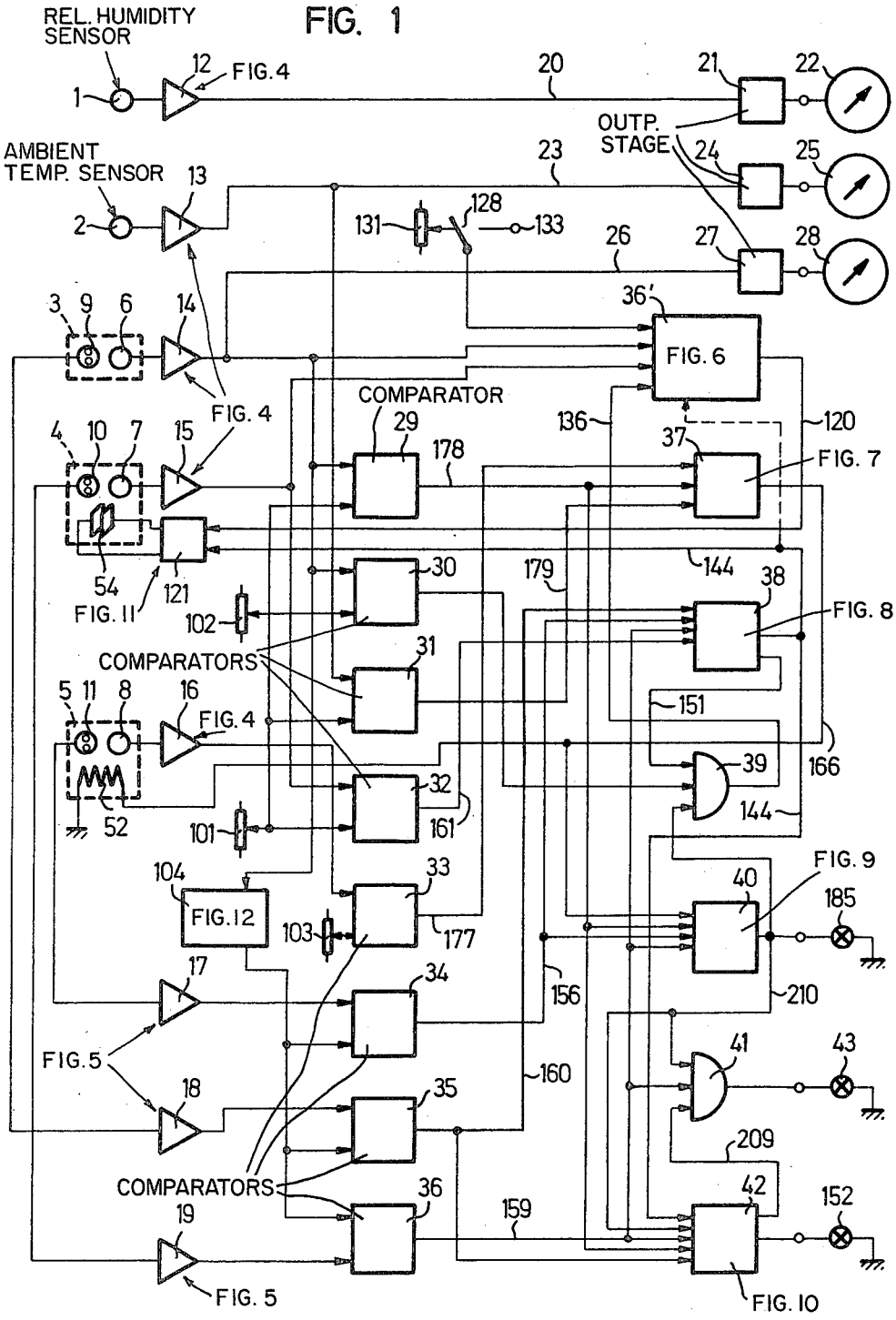
FIG. 1 is a block diagram of an embodiment of the device according to the invention.

FIG. 1 is a block diagram of a device for generating an early warning signal when there is a danger of ice forming on a road surface. For detecting the meteorological conditions and the state of the road surface, this device includes a relative humidity sensor 1, an ambient temperature sensor 2, and a sensor assembly comprising three sensor units 3, 4, and 5. The mechanical structure of the sensor assembly will be described below with reference to FIGS. 2 and 3. The sensor units 3, 4, and 5 comprise temperature sensors 6, 7, and 8, respectively, and moisture detecting gaps 9, 10, and 11, respectively, for determining whether the road surface is wet or dry. The relative humidity sensor 1 and the temperature sensors 2, 6, 7, and 8 are each connected to a respective measuring amplifier of a first group of measuring amplifiers 12, 13, 14, 15, and 16. These measuring amplifiers are preferably all of identical construction as described below in connection with FIG. 4. The moisture detecting gaps 9, 10, and 11 are each connected to a respective measuring amplifier of a second group of measuring amplifiers 17, 18 and 19 which will be described below with reference to FIG. 5.

The measuring amplifier 12 produces an output voltage dependent upon the relative humidity of the air, which voltage is supplied to an indicator 22 over a line 20 via an output stage 21. The relative humidity plays no part in generating the early warning signal as it has been found to be of little or no significance for this purpose.

The measuring amplifiers 13, 14, 15, and 16 each produce an output voltage dependent upon the temperatures determined by the respective temperature sensors 2, 6, 7, and 8. The output voltage of the measuring amplifier 13 is supplied to an ambient temperature indicator 25 over a line 23 via an output stage 24, and the output voltage of the measuring amplifier 14 is supplied to a road surface temperature indicator 28 over a line 26 via an output stage 27. The measuring amplifiers 17, 18, and 19 connected to the respective moisture detecting gaps 9, 10, and 11 produce a low output voltage when the moisture detecting gaps are moist or wet and a high output voltage when the moisture detecting gaps are dry or frozen.

Eight comparators 29–36, each having two inputs and an output, are provided for ascertaining whether the output voltages of the measuring amplifiers 13–19 exceed a certain threshold value. One of the inputs of each comparator is connected to the output of one of the measuring amplifiers, while the other of the inputs of each comparator is connected to a respective reference voltage source. The outputs of the comparators 29–36 are connected to devices 36'–42 which are for generating control signals and for evaluating the output signals of the comparators 29–36. The device shown as an AND-gate 41 having three inputs generates the early warning signal when an H-signal is supplied to all three inputs. The early warning signal is optically indicated, for example, by a lamp 43. Instead of or in addition to the lamp 43, an acoustic signal transmitter (not shown) may be provided.

Figure 2:
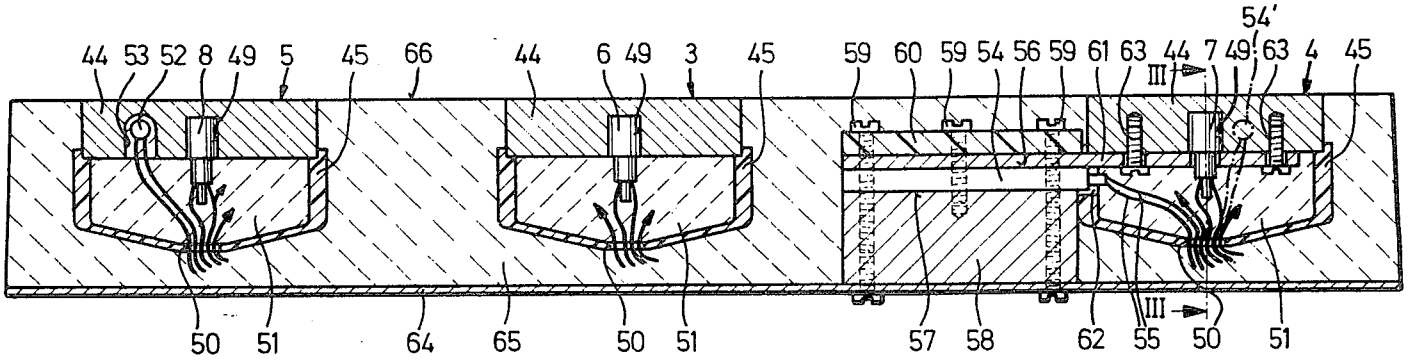
FIG. 2 is a longitudinal section through a sensor assembly of the device of FIG. 1.
Figure 3:
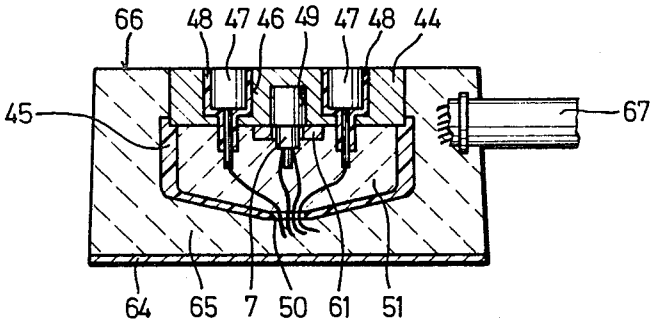
FIG. 3 is a section taken on the line III—III of FIG. 2.

Before the mode of operation of the device illustrated in FIG. 1 is set forth in detail, the structural particulars of the sensor assembly will be described with reference to FIGS. 2 and 3. This assembly comprises the three sensor units 3, 4, and 5, each of which includes a relatively thick metal disc 44, the underside of which is covered by a plastic hood 45. In each of the discs 44 are two stepped bores 46, each containing an electrode 47 embedded in a plastic jacket 48 and electrically insulated from the disc 44. The two electrodes 47, the upper end faces of which are flush with the outer surface of the disc 44, are visible only in FIG. 3. These pairs of electrodes 47 form the abovementioned moisture detecting gaps 9, 10, and 11 of the sensor units 3, 4, and 5. In the center of each disc 44, on the underside thereof, is a blind bore 49 accommodating the temperature sensor 6 in the sensor unit 3, the temperature sensor 7 in the sensor unit 4, and the temperature sensor 8 in the sensor unit 5, respectively. The temperature sensors are resistors which change their electrical resistance depending upon their temperature. The connecting wires of the electrodes 47 and the temperature sensors 6–8 leave the sensor units 3–5 through respective openings 50 in the hoods 45. The rest of the interior of each hood 45 is filled in with a casting compound 51.

The sensor unit 3 comprises only the temperature sensor 6 and the moisture detecting gap 9 formed by the two electrodes 47. The sensor unit 5 additionally comprises a heating element 52 disposed in a recess 53 in the disc 44 of the sensor unit 5. The heating element 52 is used to heat the disc 44 of the sensor unit 5 and thus to heat the moisture detecting gap 11 in order to melt snow or ice lying on the moisture detecting gap 11 or, according to the weather, in order that the moisture detecting gap 11 will dry out before the unheated moisture-detecting gap 9. The sensor unit 4 comprises, instead of the heating element, a plate-shaped cooling element 54, which may, for example, be a so-called Peltier element. According to the direction of the current supplied to the cooling element 54 over connecting wires 55, either the top 56 of the element 54 cools down and the bottom 57 thereof heats up, or vice versa. The bottom 57 of the cooling element 54 rests upon a metal block 58. By means of screws 59 and a heat-insulating plate 60, a metal heat conductor 61 is pressed against the top 56 of the cooling element 54. Part of the heat conductor 61 extends beyond the cooling element 54 through an aperture 62 in the hood 45 and into the interior of the latter. This extension of the heat conductor 61 is secured to the disc 44 of the sensor unit 4 by means of screws 63. The connecting wires 55 of the cooling element 54 pass through the aperture 62 and the opening 50 in the hood 45. Screwed to the underside of the metal block 58 is a heat-dissipation plate 64 which extends along the entire length of the sensor assembly. The three sensor units 3, 4, and 5, including the cooling element 54 and the metal block 58, are cast integral in a parallelepiped block 65 of casting resin, the underside of the block 65 being covered by the heat-dissipation plate 64. The outer faces of the discs 44 and the upper end faces of the electrodes 47 lie in the same plane as the upper surface 66 of the block 65. The entire sensor assembly is inset into the road, the upper surface 66 being flush with the road surface. All of the connecting wires (only partially shown) for the temperature sensors 6, 7, and 8, the electrodes 47, the heating element 52, and the cooling element 54 are cast integral in the block 65 and leave the latter through a cable 67, shown in part only in FIG. 3, to be connected to the corresponding inputs of the measuring amplifiers 12–19 as shown in FIG. 1.

Figure 4:
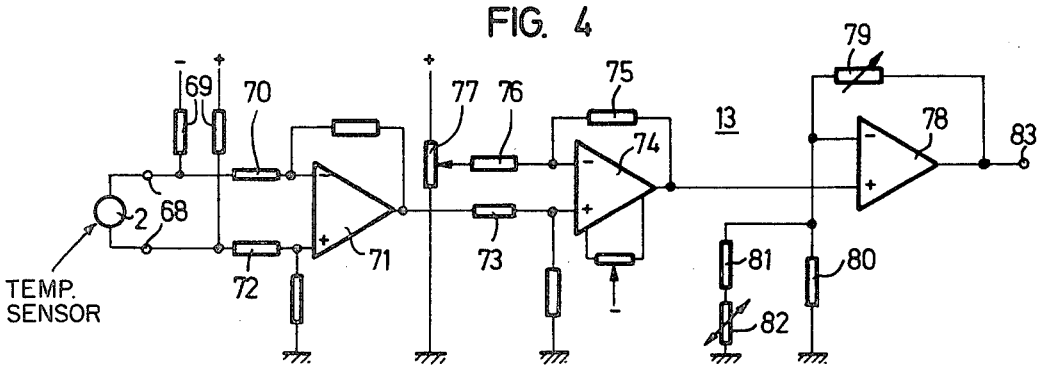
FIG. 4 is a circuit diagram of a measuring amplifier for producing an output signal when the temperature of the air, of the road surface, or of one of the sensors reaches a certain value.

FIG. 4 is a circuit diagram of the measuring amplifier 13, standing as an example for all the measuring amplifiers 12–16. Input terminals 68 of the measuring amplifier 13 are connected to the temperature sensor 2, which is, as already mentioned, a temperature-dependent resistor. A voltage from a stabilized power source designated by − and + is applied to the temperature sensor 2 across two resistors 69. The temperature-dependent voltage appearing at the temperature sensor 2 is fed across a first series resistor 70 to the inverting input of a differential amplifier 71 and across a second series resistor 72 to the non-inverting input of the differential amplifier 71. The values of the resistors 69 are about ten times less than the values of the series resistors 70 and 72. The effect of the above-described input circuit of the differential amplifier 71 is that the length of the lines connecting the temperature sensor 2 to the input terminals 68 has virtually no influence upon the temperature-dependent voltage appearing at the temperature sensor 2. The signal appearing at the output of the differential amplifier 71 reaches the non-inverting input of a differential amplifier 74 across a resistor 73. The inverting input of the differential amplifer 74 is connected across a feedback resistor 75 to the output of the differential amplifier 74 and across a resistor 76 to the tap of a potentiometer 77. The signal from the output of the differential amplifier 74 is supplied directly to the non-inverting input of a further differential amplifier 78. The inverting input of the differential amplifier 78 is connected across a variable resistor 79 to the output of the differential amplifier 78, across a resistor 80 to ground and via the series connection of a resistor 81 and a thermistor 82 to ground. The output of the differential amplifier 78 is connected to an output terminal 83 of the measuring amplifier. If the voltage appearing at the output terminal 83 were plotted on the abscissa of a graph, and the voltage applied between the input terminals 68 on the ordinate, the resultant curve would be a straight line. By means of the potentiometer 77, this straight line can be displaced parallel to the abscissa. The slope of this straight line can be adjusted with the aid of the variable resistor 79. This enables optimum adjustment of the working point of the measuring amplifier.

Figure 5:
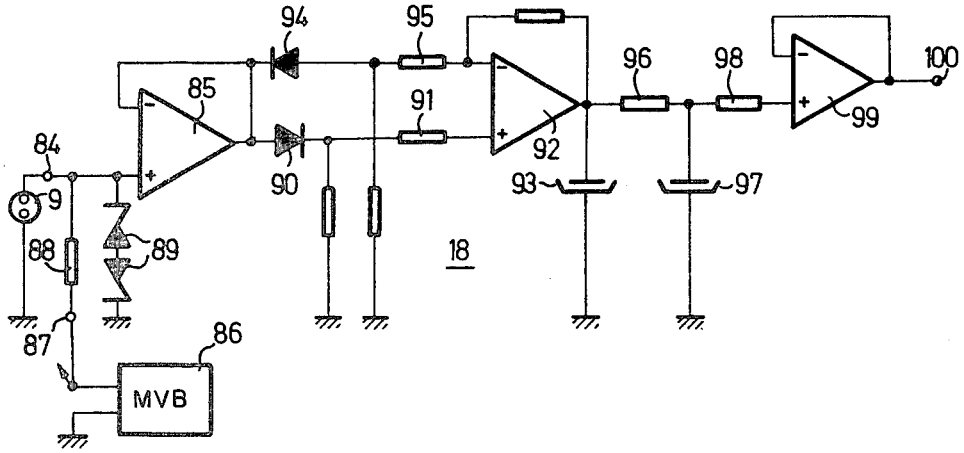
FIG. 5 is a circuit diagram of a further measuring amplifier for producing a signal when the road surface is wet or when one of the sensors indicates wetness.

FIG. 5 is a circuit diagram of one of the measuring amplifiers 17, 18, or 19, which ascertain whether the moisture detecting gaps 9, 10, and 11 are dry or moist. The moisture detecting gap 9, for example, formed by the electrodes 47 of the sensor unit 3, is connected both to ground and to an input terminal 84 which is directly connected to the non-inverting input of a differential amplifier 85. Via a second input terminal 87 and a high-valued resistor 88, alternating rectangular pulses are applied to the moisture detecting gap 9 from a multivibrator 86 which alternately produces at its output a positive and a negative voltage relative to ground.

If the moisture detecting gap 9 is moist, it exhibits a relatively low resistance, and the voltage reaching the non-inverting input of the differential amplifier 85 is low. If the moisture detecting gap 9 is dry, it has a high resistance, and the alternating voltage fed to the non-inverting input of the differential amplifier 85 is high. For limiting this input voltage, a series connection of two oppositely connected Z-diodes 89 is provided. The inverting input of the differential amplifier 85 is connected to its output, whereby the differential amplifier 85 operates as a normal amplifier stage. Appearing at the output of the differential amplifier 85 in accordance with the alternating input voltage is an alternating output voltage, the magnitude of which is dependent upon the dry or wet condition of the moisture detecting gap 9. The positive rectangular waves appearing at the output of the differential amplifier 85 reach the non-inverting input of a further differential amplifier 92 via a diode 90 and across a resistor 91. A capacitor 93 is charged by the positive voltage appearing at the output of the differential amplifier 92. Via a diode 94 and across a resistor 95, the negative rectangular waves appearing at the output of the differential amplifier 85 reach the inverting input of the differential amplifier 92, which likewise produces at its output a positive voltage used for charging the capacitor 93. The differential amplifier 92 and the diodes 90 and 94 act as a full-wave rectifier for the rectangular pulses appearing at the output of the differential amplifier 85, whereby the capacitor 93 connected at the output of the differential amplifier 92 is charged at a high voltage when the moisture detecting gap 9 is dry and at a low voltage when the moisture detecting gap 9 is moist. Via a filter section composed of a resistor 96 and a capacitor 97, the DC voltage dependent upon the condition of the moisture detecting gap 9 is supplied across a resistor 98 to the non-inverting input of a differential amplifier 99. Differential amplifier 99 is connected as a DC amplifier, the output of which is connected to an output terminal 100 of the measuring amplifier 18 illustrated in FIG. 5.

The multivibrator 86 feeds the moisture detecting gap circuits of all three measuring amplifiers 17, 18, and 19. The alternating feed of the moisture detecting gaps 9, 10, and 11 by means of positive and negative rectangular pulses prevents incrustation at the gaps since no electrolysis can take place.

No detailed circuit diagram of the comparators 29–36 need be illustrated inasmuch as such components are well known. They may, for example, comprise a differential amplifier, the non-inverting input of which is supplied with a reference voltage, while the comparison voltage is applied to the inverting input. A H-signal then appears at the output of the differential amplifier when the comparison voltage exceeds the reference voltage. The reference voltage for the comparators 29, 31, and 32 can be adjusted by means of a potentiometer 101. The reference voltages for the comparators 30 and 33 are taken off potentiometers 102 and 103, respectively. The reference voltage for the comparators 34, 35, and 36 is produced in a device 104 as a function of the road surface temperature determined by the temperature sensor 6 in the sensor unit 3 (see FIG. 1). Thus the threshold value at which the comparators 34, 35, and 36 respond is continuously variable.

Figure 12:
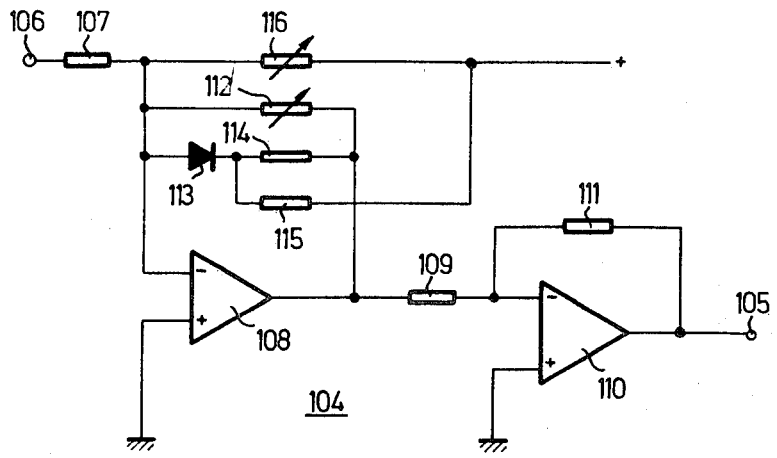
FIG. 12 is a diagram of circuitry for producing a voltage having a continuously variable threshold value.
Figure 13:
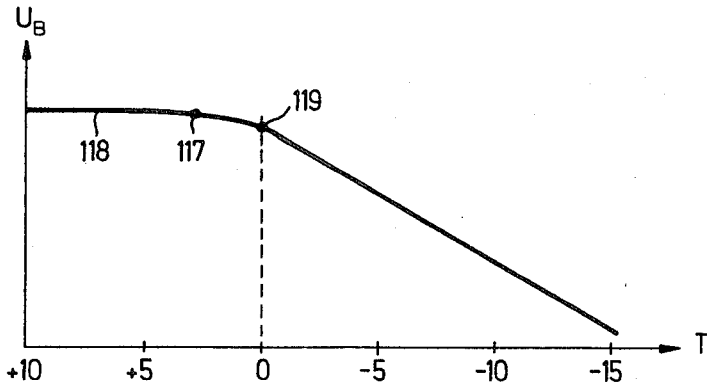
FIG. 13 is a graph showing the continuously variable threshold-value voltage as a function of the temperature of the road surface.

FIG. 12 is a circuit diagram of the aforementioned device 104, while FIG. 13 shows the dependence of the reference voltage $U_B$, which appears at an output terminal 105 of the device 104, upon the temperature T of the road surface. The signal appearing at the output of the measuring amplifier 14, dependent upon the temperature of the road surface, is supplied via an input terminal 106 and across a resistor 107 to the inverting input of a differential amplifier 108, the non-inverting input of which is grounded. The output of the differential amplifier 108 is connected across a resistor 109 to the inverting input of a further differential amplifier 100, and this input is connected across a feedback resistor 111 to the output of the differential amplifier 100, the non-inverting input of which is grounded. The output of the differential amplifier 108 is back-coupled to the inverting input across a variable resistor 112 and via the series connection of a diode 113 and a resistor 114. A bias which is adjustable by means of a variable resistor 116 is supplied to the diode 113 across a resistor 115. The bias of the diode 113 is adjusted in such a way that this diode begins to operate when an input voltage corresponding to a road surface temperature of about 3° C. is applied to the input terminal 106. This is indicated at point 117 of the curve 118 in FIG. 13. At point 119, corresponding to a road surface temperature of 0° C., the diode is fully conductive, and the output voltage, i.e., the reference voltage for the comparators 34, 35, and 36, continues to exhibit a linear drop as the temperature decreases.

It will be seen from FIG. 1 that the comparator 29 is connected to the output of the measuring amplifier 14. The comparator 29 generates an H-signal when the road surface temperature determined by the temperature sensor 6 is 0° C. or less. The comparator 30 is likewise connected to the measuring amplifier 14 and generates an H-signal when the road surface temperature is less than 4° C. The comparator 31 is connected to the measuring amplifier 13 and generates an H-signal when the ambient temperature determined by the temperature sensor 2 is less than 0° C. The comparator 32 is connected to the output of the measuring amplifier 15 and generates an H-signal when the temperature of the sensor unit 4, determined by the temperature sensor 7, is less than 0° C. It is essential that the comparator 32 exhibit hysteresis. For example, it generates the H-signal when the temperature of the sensor unit 4 drops to −1° C. The H-signal does not disappear again until the temperature of the sensor unit 4 has risen to +1° C. The comparator 33 is connected to the measuring amplifier 16 and generates an H-signal when the temperature of the sensor unit 5, determined by the temperature sensor 8, is less than 0° C.

The comparators 34, 35, and 36 each generate an H-signal when the respective moisture detecting gaps 9, 10, and 11 are dry. An L-signal appears at the outputs of each of the comparators 34, 35, and 36 when the values of the voltages supplied by the respective measuring amplifiers 17, 18 and 19 fall below the continuously variable threshold value described above with reference to FIG. 13.

Figure 6:
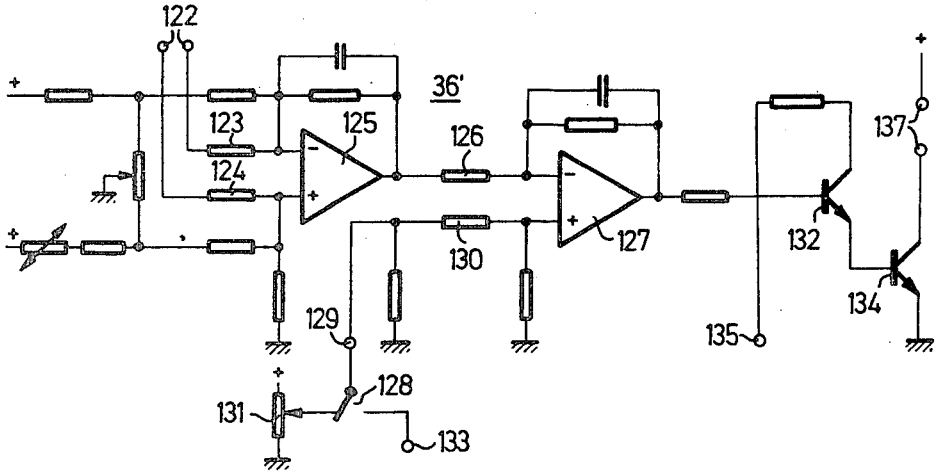
FIG. 6 is a diagram of circuitry for controlling a cooling element in one of the sensors.

The output signals of the measuring amplifiers 14 and 15 are supplied to a control device 36' for establishing the difference between the road surface temperature determined by the temperature sensor 6 and the temperature of the coolable sensor unit 4 determined by the temperature sensor 7. Connected to the output of the control device 36' is a two-wire conductor 120 over which the supply current is conveyed to the cooling element 54 in the sensor unit 4 via a reversing switch 121 as a function of the aforementioned difference in temperatures. A circuit diagram of the control device 36' is illustrated in more detail in FIG. 6. The signals generated by the measuring amplifiers 14 and 15 are supplied via input terminals 122 and across respective resistors 123 and 124 to the inverting and non-inverting inputs, respectively, of a differential amplifier 125. The output of the differential amplifier 125 produces a voltage proportional to the mentioned difference in temperatures, which is supplied across a resistor 126 to the inverting input of a differential amplifier 127 acting as a comparator. Via a changeover switch 128, a further input terminal 129, and across a resistor 130, a reference voltage, adjustable at a potentiometer 131, is supplied to the other input of the differential amplifier 127, whereby the mentioned difference in temperatures can be adjusted. When the output voltage delivered by the differential amplifier 125 does not attain the value of the reference voltage, the differential amplifier 127 generates a positive output signal which is supplied to the base of a transistor 132. When the changeover switch 128 is in its other, (not illustrated) position, a reference voltage can be supplied from outside over a connection terminal 133; as a result, the mentioned difference in temperatures can be controlled in such a way that a fixed early warning time is achieved. The transistor 132 controls a switching transistor 134 when a positive signal is supplied to an input terminal 135 over a line 136 from an AND-gate 39 (see FIG. 1). The collector-to-emitter path of the switching transistor 134 is connected between one of two output terminals 137 and ground, while the other output terminal 137 is connected to the positive pole of a power source (not shown). The task of the control device 36' described above is to ensure that when the road surface temperature drops below 4° C., a fixed difference exists between the temperature of the road surface and the temperature of the sensor unit 4.

Figure 11:
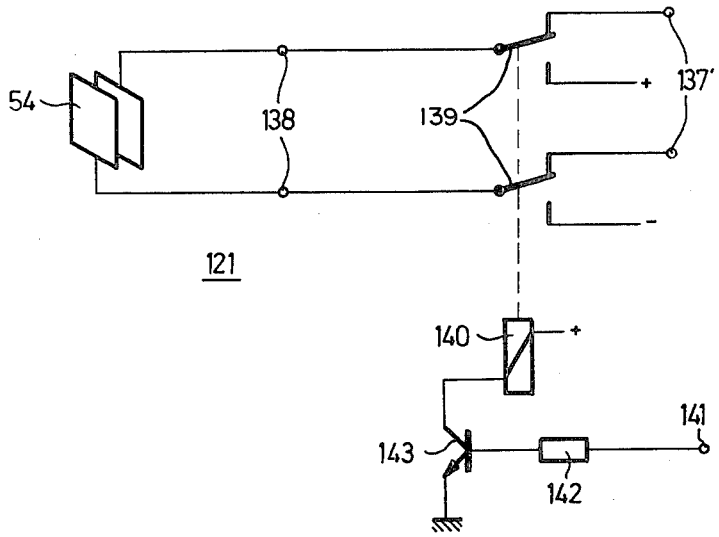
FIG. 11 is a diagram of a circuit arrangement for switching over the mode of operation of the cooling element.

The circuit of the reversing switch 121 is illustrated in FIG. 11. It comprises two input terminals 137' and two output terminals 138. The cooling element 54 of the sensor unit 4 is connected to the output terminals 138, while the input terminal 137' are connected over the two-wire conductor 120 to the output terminals 137 of the control device 36' shown in FIG. 6. The output terminals 138 are connected to the input terminals 137' via make-and-break contacts 139 of a relay 140. When the relay 140 attracts, the direction of the current flowing through the cooling element 54 is reversed, so that the cooling element 54 heats the sensor unit 4. The relay 140 attracts when a positive voltage is supplied to the base of a transistor 143 via an input terminal 141 and across a resistor 142. This voltage is delivered by a device 38 which generates an H-signal when the prerequisites for heating the normally cooled sensor unit 4 are met. The H-signal is supplied to the reversing switch 121 over a conductor 144.

Figure 8:
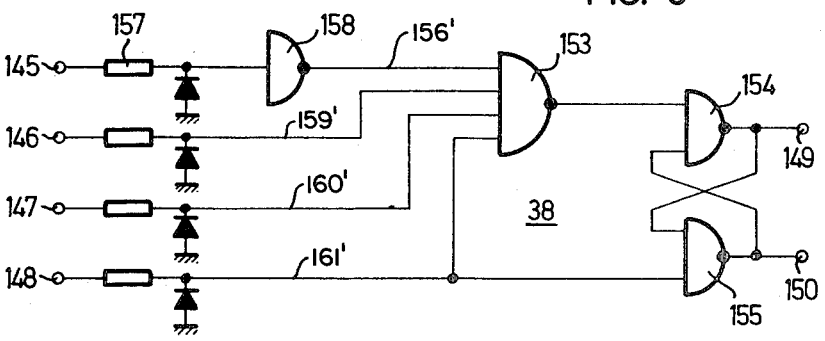
FIG. 8 is a diagram of circuitry for heating another sensor of the sensor assembly.

FIG. 8 is a circuit diagram of the aforementioned device 38 which controls the reversing switch 121. It comprises four input terminals 145, 146, 147, and 148, and two output terminals 149 and 150. The first output terminal 149 is connected by a conductor 144 to the reversing switch 121 and to an input terminal of a device 42 for generating a signal when there is ice on the road surface, indicated by a lamp 152. The second output 150 is connected by a conductor 151 to one of the inputs of AND-gate 39 for activating the control device 36'. The circuit comprises a four input NAND-gate 153 and a flip-flop having two NAND-gates 154 and 155. The output of the NAND-gate 153 is connected to the setting input of the flip-flop. One of the outputs of the flip-flop is connected to the output terminal 149 and the other to the output terminal 150. The output signal of the comparator 34 is supplied to the input terminal 145 over a conductor 156 when the moisture detecting gap 11 of the sensor unit 5 is dry (see FIG. 1). This signal reaches the first input of the NAND-gate 153 via conductor 156' across a protective resistor 157 and an inverter 158. The output signal of the comparator 36 is supplied to the second input of the NAND-gate 153 over a conductor 159, the input terminal 146 and a conductor 159'. This output signal appears when the moisture detecting gap 10 of the sensor unit 4 is dry. The output signal of the comparator 35 is supplied to the third input of the NAND-gate 153 over a conductor 160, the input terminal 147 and a conductor 160' when the moisture detecting gap 9 of the sensor unit 3 is dry. The fourth input of the NAND-gate 153 is connected to the reset input of the aforementioned flip-flop. A signal from the comparator 32 is supplied to these two inputs over a conductor 161, the input terminal 148 and a conductor 161' when the temperature detected by the temperature sensor 7 in the sensor unit 4 is less than 0° C. The device 38 illustrated in FIG. 8 generates an H-signal at its output 150 as long as the temperature of the sensor unit 4 is above 0° C. regardless of what kind of signals are present at the remaining input terminals 145, 146, and 147. On the other hand, the device 38 generates an H-signal at its output terminal 149 when an H-signal is supplied to the input terminal 145, i.e., when the moisture detecting gap 11 of the heatable sensor unit 5 is dry and an L-signal is present at each of the remaining input terminals 146, 147, and 148, i.e., when the moisture detecting gap 10 of the coolable sensor unit 4 and the moisture detecting gap 9 of the sensor unit 3 are both wet and the temperature of the coolable sensor unit 4 is more than 0° C.

Figure 7:
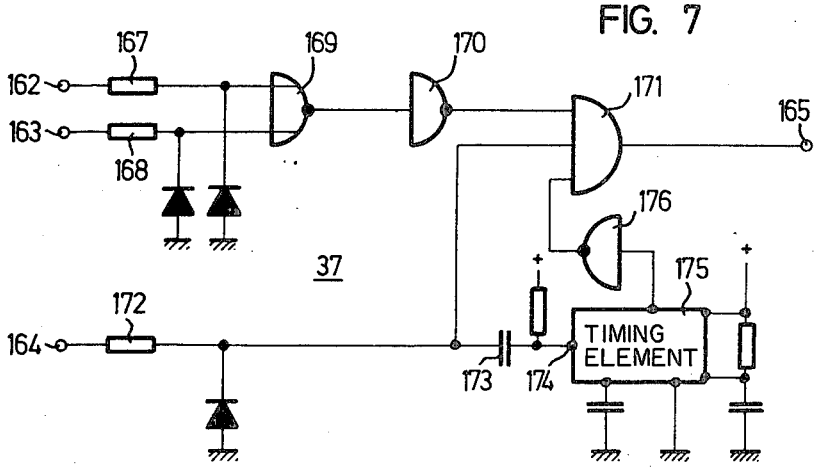
FIG. 7 is a diagram of circuitry for heating one of the sensors of the sensor assembly.

The circuitry of the device 37 is shown in FIG. 7. It comprises three input terminals 162, 163, and 164 and an output terminal 165 which is connected over a conductor 166 to the heating element 52 of the heatable sensor unit 5 (see FIG. 1). The input terminals 162 and 163 are each connected across respective protective resistors 167 and 168 to one of the two inputs of a NOR-gate 169. The output of the NOR-gate 169 is connected via an inverter 170 to a first input of an AND-gate 171. The output of the AND-gate 171 is connected to the output terminal 165. The input terminal 164 is connected across a protective resistor 172 to a second input of the AND-gate 171 and, via a capacitor 173, to the input 174 of a timing element 175. The output of the timing element 175 is connected via an inverter 176 to a third input of the AND-gate 171. The output signal of the comparator 33 is supplied over a conductor 177 to the input terminal 164 of the device 37 when the temperature of the heatable sensor unit 5 is less than 0° C. This comparator 33 H-signal reaches the second input of the AND-gate 171. At the beginning of this H-signal, a short pulse is sent via the capacitor 173 to the input 174 of the timing element 175. The timing element 195 thereupon delivers an L-signal at its output for an adjustable period of from five to twenty minutes. This L-signal is inverted to the inverter 176 and is supplied to the third input of the AND-gate 171. An H-signal is supplied to the input terminal 162 from the comparator 29 over a conductor 178 when the road surface temperature detected by the temperature sensor 6 in the sensor unit 3 is below 0° C. An H-signal is supplied to the input terminal 163 from the comparator 31 over a conductor 179 when the ambient temperature detected by the ambient temperature sensor 2 is less than 0° C. The H-signals from both comparators 29 and 31 reach the inputs of the NOR-gate 169, to which the inverter 170 is connected, with the result that an H-signal is present at the first input of the AND-gate 171 when either the road surface temperature or the ambient temperature or both are below 0° C. The device 37 energizes the heating element 52 of the sensor unit 5 for a period of time which can be set by means of the timing element 175 when either the ambient temperature or the road surface temperature or both are below 0° C. and the temperature of the heatable sensor unit 5 drops below 0° C. As soon as the temperature of the sensor unit 5 is caused to rise above 0° C. by heating, the heating element 52 ceases to be energized even if the period of time to which the timing element 175 has been set has not yet elapsed.

Figure 9:
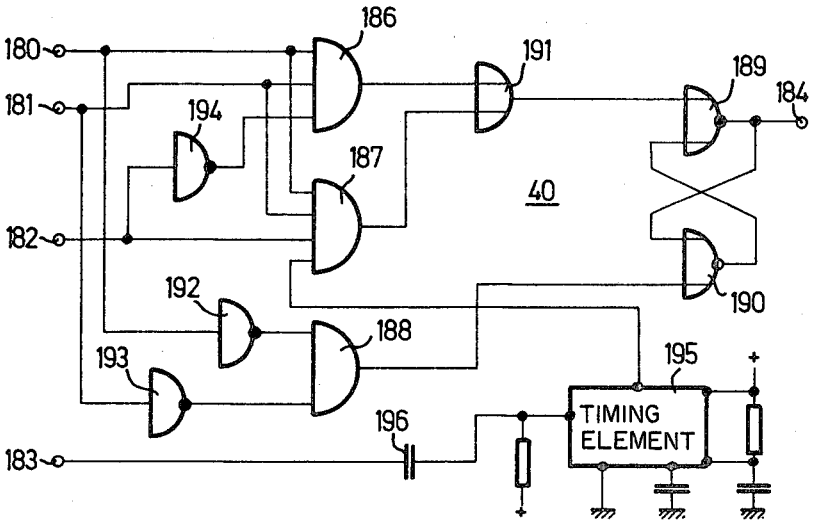
FIG. 9 is a diagram of circuitry for producing a signal when the road surface is wet.

The device 40 is used to indicate whether the road surface is moist or dry. The circuitry of this device 40 is illustrated in FIG. 9. It comprises four input terminals 180, 181, 182, and 183 and an output terminal 184 which is connected to an indicating lamp 185 which lights up when the road surface is moist or wet. The device 40 further comprises three AND-gates 186, 187, and 188 and a flip-flop composed of two NOR-gates 189 and 190, one output of this flip-flop being connected to the output terminal 184. The outputs of the AND-gates 186 and 187 are each connected to a respective input of an OR-gate 191, the output of which is connected to the setting input of the aforementioned flip-flop. The two input terminals 180 and 181 are connected directly to two respective inputs of the AND-gates 186 and 187 and, via respective inverters 192 and 193, to the two inputs of the AND-gate 188. The output of the AND-gate 188 is connected to the reset input of the above-mentioned flip-flop. The input terminal 180 is connected to the comparator 34 over the conductor 156 and receives an H-signal when the moisture detecting gap 11 of the heatable sensor unit 5 is dry. The input terminal 181 is connected to the comparator 36 over the conductor 159 and receives an H-signal when the measuring gap 10 of the coolable sensor unit 4 is dry. The input terminal 182 is supplied with an H-signal from the comparator 29 over the conductor 178 when the road surface temperature drops below 0° C.; this H-signal reaches one of the inputs of the AND-gate 187 directly and reaches the third input of the AND-gate 186 via an inverter 194. Accordingly, the mentioned flip-flop is set via the AND-gate 186 and the OR-gate 191 when the moisture detecting gaps 10 and 11 are dry and the road surface temperature is above 0° C., this flip-flop not transmitting any output signal when set. However, if the moisture detecting gaps 10 and 11 are moist or wet, the flip-flop is reset via the inverters 192 and 193 and the AND-gate 188, an H-signal appearing at the output terminal 184.

The input terminal 183 is connected to the output terminal 165 of the device 37 over the conductor 166 and receives an H-signal when the device 37 energizes the heating element 52 for heating the sensor unit 5. The input of a timing element 195 is connected to the input terminal 183 via a capacitor 196. The timing element 195, which may be an integrated circuit, e.g., NE 555, is connected in such a way that it responds to the trailing edge of the H-signal generated by the device 37 and transmits at its output a short positive pulse which is supplied to one of the inputs of the AND-gate 187.

When the moisture detecting gaps 10 and 11 are dry, the road surface temperature is less than 0° C., and the timing element 195 generates the short pulse, an H-signal appears briefly at the output of the AND-gate 187, whereby the mentioned flip-flop is again set, the output signal at the output terminal 184 disappearing. The flip-flop is set by the AND-gate 188 for generating the output signal when the two moisture detecting gaps 10 and 11 are moist and the road surface temperature is below 0° C.

Figure 10:
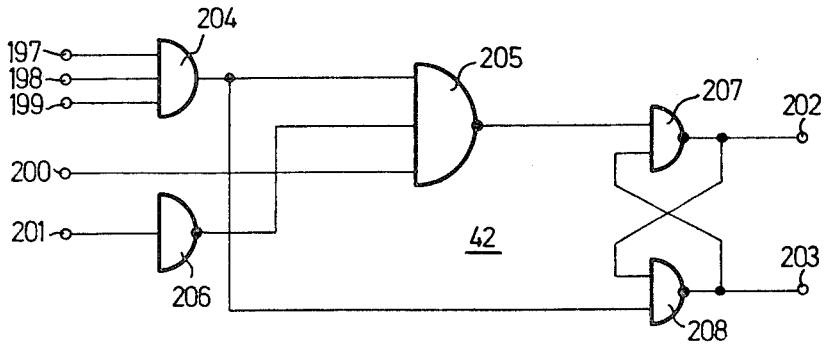
FIG. 10 is a diagram of circuitry for producing a signal when the road surface is icy.

Lastly, the circuitry of the device 42 for generating a signal when there is ice on the road surface is illustrated in FIG. 10. The device 42 comprises five input terminals 197–201 and two output terminals 202 and 203. The first three input terminals 197, 198, and 199 are each connected to a respective input of an AND-gate 204, the output of which is connected to an input of a NAND-gate 205.

The fourth input terminal 200 is directly connected to an input of the NAND-gate 205, and the fifth input terminal 201 is connected via an inverter 206 to an input of the NAND-gate 205. The output of the NAND-gate 205 is connected to the setting input of a flip-flop composed of NAND-gates 207 and 208, while the output of the NAND-gate 204 is connected to the reset input of this flip-flop. The output terminal 202 is connected to the lamp 152 which indicates that there is ice on the road surface (FIG. 1). The output terminal 203, which carries the inverted signal of the output terminal 204, is connected over a conductor 209 to an input of the AND-gate 41 used to generate the early warning signal.

The input terminal 197 is connected over the conductor 178 to the comparator 29, which transmits an H-signal when the road surface temperature is below 0° C. The input terminal 198 is connected over the conductor 160 to the comparator 35, which generates an H-signal when the moisture detecting gap 9 of the sensor unit 5 is dry or icy. The input terminal 199 is connected over a conductor 210 to the output of the device 40, which generates an H-signal when the road surface is moist. The input terminal 200 is connected over the conductor 144 to the output terminal 149 of the device 38 for reversing the mode of operation of the cooling element 54. The input terminal 201 is connected over the conductor 159 to the comparator 36, which transmits an H-signal when the measuring gap 10 of the coolable sensor unit 4 is dry or icy.

The early warning signal, the moisture signal, and the ice-formation signal, indicated by the lamps 43, 185, and 152, respectively, are generated on the basis of the temperatures detected by the temperature sensors 2, 6, 7, and 8 and the conditions detected by the moisture detecting gaps 9, 10, and 11, the heating of the sensor unit 5 and the cooling or heating of the sensor unit 4 taking place as a function of the weather conditions, i.e., being phenomenon-dependent. The mode of operation of the early ice-warning device described above will now be explained in relation to various meteorological conditions.

EXAMPLE 1

The weather is dry, and the temperature, which has been above 0° C., begins to fall. All three moisture detecting gaps 9, 10, and 11 are high impedance, and the output signals of the measuring amplifiers 17, 18, and 19 are accordingly higher than the reference voltage produced by the device 104. Each of the associated comparators 34, 35, and 36 therefore generates an H-signal. The remaining comparators 29–33 do not generate any H-signal because all of the temperatures determined by the temperature sensors 2, 6, 7, and 8 are above the freezing point. All of the devices 36–42 are inactive. When the ambient temperature drops below 0° C., as detected by the temperature sensor 2, the comparator 31 generates an H-signal which is carried over the conductor 179 to the input terminal 163 of the device 37 for controlling heating of the sensor unit 5 (see FIG. 7). Hence an H-signal is supplied to the first input of the AND-gate 171 from the inverter 170. However, since no H-signal is supplied to the other two inputs of the AND-gate 171, nothing happens for the moment. When the cold ambient temperature also causes the road surface temperature to drop below 0° C., this fact is detected by the temperature sensor 6 of the sensor unit 3 and by the temperature sensor 8 of the sensor unit 5, which is not yet heated at this time. Accordingly, the comparators 29, 30, and 33 each generate an H-signal. The H-signal generated by the comparator 33 arrives at the second input of the AND-gate 171 over the conductor 177 and the input terminal 164 of the device 37, and the leading edge of this H-signal excites the timing element 175, so that the latter transmits an H-signal to the third input of the AND-gate 171 via the inverter 176. At the output of the AND-gate 171 there appears an H-signal which is supplied over the output terminal 165 and the conductor 166 to the heating element 52 for heating the sensor unit 5 and to the input terminal 183 of the device 40 (illustrated in FIG. 9) for generating the moisture signal, although the device 40 does not respond because the moisture detecting gaps 10 and 11 are dry.

After the preferably 15-minute period of time set in the timing element 175 has elapsed, the latter inhibits the AND-gate 171. During that period of time, the sensor unit 5, and hence the moisture detecting gap 11, have been heated. The temperature sensor 8 detects this heating, and when the temperature of the sensor unit 5 rises above 0° C., the comparator 33 no longer generates an H-signal. If this rise in temperature takes place within the aforementioned 15 minutes, the AND-gate 171 is inhibited before the time of the timing element 175 has elapsed. Thereafter, the sensor unit 5 cools down again; and when its temperature again drops below 0° C., the heating element 52 is again energized as described above. This process continues to repeat itself as long as the road surface temperature is below 0° C. and the moisture detecting gaps 9, 10, and 11 are dry.

If dry snow falls during this time, it melts on the heated sensor unit 5. The moisture detecting gap 11 thereby becomes conductive, and the comparator 34 no longer generates an H-signal. The output of the comparator 34 is connected over the conductor 156 both to the input terminal 180 of the device 40 and to the input terminal 145 of the device 38. As a result, the NAND-gate 153 of the device 38 generates an H-signal and sets the flip-flop composed of the NAND-gates 154 and 155. Consequently, the reversing switch 121 is moved into the "heating of sensor unit 4" position in that the relay 140 of the reversing switch 121 attracts. Thus the moisture detecting gap 10 of the sensor unit 4 is also heated. This heating continues until the temperature sensor 7 of the sensor unit 4 reports that the temperature of the moisture detecting gap 10 has risen above 0° C.; the H-signal at the output of the comparator 32 thereupon disappears, so that no H-signal any longer arrives at the NAND-gate 153 of the device 38 over the conductor 161 and the input terminal 148, whereby heating of the sensor unit 4 ceases.

If dry snow was lying on the heated moisture detecting gap 10, it now melts, so that the moisture detecting gap 10 becomes moist; this is indicated by the comparator 36 in that the H-signal at its output disappears. This causes the AND-gate 188 of the device 40 to be actuated via the inverters 192 and 193, and the flip-flop comprising the NOR-gates 189 and 190 to be set, so that an H-signal is generated at the output terminal 184 of the device 40, whereby the indicating lamp 185 lights up as a sign that the moisture detecting gap 10 is wet.

The H-signal at the output terminal 184 arrives at the input terminal 200 of the device 42, whereby the NAND-gate 205 transmits an H-signal and sets the flip-flop comprising the NAND-gates 207 and 208. The indicating lamp 152 thereupon lights up to indicate that there is ice on the road surface. This is not strictly true, but there is snow on the road surface which leads to slickness, and the result is similar to an icy surface.

The H-signal at the output terminal 184 of the device 40 also reaches an input terminal of the AND-gate 39, so that there appears at the output of the AND-gate 39 an H-signal which is applied over the conductor 136 to the input terminal 135 of the control device 36′ and switches on the power supply for the cooling element 54 for cooling the sensor unit 4. Cooling of the moisture detecting gap 10 of the sensor unit 4 continues until the wetness or moisture on the moisture detecting gap 10 freezes and this moisture detecting gap thereby becomes high impedance again, which causes the comparator 36 to generate an H-signal again, or until the difference in temperatures between the moisture detecting gaps 9 and 10, monitored by the control device 36′, reaches a sufficiently high value. As long as the personnel responsible for road maintenance take no action, the heating and cooling cycles of the moisture detecting gap 10 continue to alternate.

It shall now be assumed that a thawing agent, such as salt, is spread on the road. In this case, all three moisture detecting gaps become low impedance because the salt causes the snow to melt even at a temperature of less than 0° C. The result is, among other things, that the flip-flop formed of the NAND-gates 207 and 208 of the device 42 is reset, whereby the indicating lamp 152 goes out because sufficient salt has been spread on the road and hence it is no longer icy. If, for example, too little salt had been spread, i.e., just enough so that the moisture detecting gap 9 (at road surface temperature) became low impedance but the (cooled) moisture detecting gap 10 remained high impedance, the indicating lamp 152 would go out and the indicating lamp 43 would light up to show that there was a danger of ice-formation. The lamp 43 lights up because an H-signal is supplied to the AND-gate 41 over the conductor 210 from the output terminal 184 of the device 40, the H-signal generated by the comparator 36 is supplied to the second input of the AND-gate 41 over the conductor 159, and the H-signal present at the output terminal 203 of the device 42 is supplied to the third input of the AND-gate 41 over the conductor 209. The comparator 36 generates an H-signal because the moisture detecting gap 10 of the cooled sensor unit 4 is still covered with ice because too little salt has been spread.

EXAMPLE 2

The weather is wet, and the temperature, which has been above 0° C, begins to fall. The moisture detecting gaps 9, 10, and 11 are wet and therefore all low impedance. Accordingly, the respective comparators 34, 35, and 36 all generate an L-signal. The AND-gate 188 of the device 40 is therefore actuated via the inverters 192 and 193, and the flip-flop comprising the two NOR-gates 189 and 190 is reset, an H-signal appearing at the output terminal 184 and causing the indicating lamp 185 to light up as an indication that the road is wet. If the ambient temperature now drops below 0° C. and the road surface temperature below, say, +4° C., this being ascertained by the comparators 30 and 31 in that they each transmit an H-signal at their outputs, then all three inputs of the AND-gate 39 receive an H-signal as a result. The H-signal generated at the AND-gate 39 arrives at the input terminal 135 of the control device 36′ over the conductor 136. Since the difference in temperatures between the sensor units 3 and 4, and hence between the moisture detecting gaps 9 and 10, is small, the switching transistor 134 becomes conducting, whereby power is supplied to the cooling element 54 via the reversing switch 121 in order to cool the moisture detecting gap 10. Cooling continues until the wetness or moisture on moisture detecting gap 10 freezes and this moisture detecting gap thereby becomes high impedance. The comparator 36 thereby generates at its output an H-signal which arrives over the conductor 159 at the AND-gate 41, at the output of which an H-signal appears because an H-signal is supplied to each of the other two inputs of the AND-gate 41 from the output terminal 184 of the device 40 and the output terminal 203 of the device 42, respectively. The H-signal at the output of the AND-gate 41 causes the indicating lamp 43 to light up, this early warning signal indicating that the danger of ice-formation exists. If the temperature of the road surface drops still further, and if no thawing agent is spread despite the indication of the early warning signal, there is an acute danger that a road surface temperature of about 0° C., the water on that surface will freeze. If the ambient temperature or the road surface temperature falls below the limit of 0° C., the heating element 52 of the sensor unit 5 is cyclically switched on and off as described in Example 1. If the road surface is actually covered with a sheet of ice, then the moisture detecting gaps 9 and 10 are also covered with ice and are high impedance; this causes the device 38 to initiate heating of the moisture detecting gap 10 instead of cooling thereof. When the moisture detecting gap 10 of the sensor unit 4 becomes low impedance because of the heating, the device 42 generates an H-signal at its output terminal 202 and an L-signal at its output terminal 203; as a result, the ice-formation signal is transmitted instead of the early warning signal, so that the indicating lamp 43 goes out and the indicating lamp 152 lights up. The condition of the icy road is monitored by the alternate heating and cooling of the moisture detecting gap 10 until the spreading of a thawing agent or a rise in temperature causes the moisture detecting gap 9 of the sensor unit 3 to become low impedance. When this happens, either the lamp 43 lights up instead of the ice-formation lamp 152 if the moisture detecting gap 10 still becomes high impedance upon cooling thereof, or both lamps 43 and 152 go out if all three moisture detecting gaps 9, 10, and 11 continuously remain low impedance.

The indicating lamp 185, which indicates that the road is wet, goes out when the moisture detecting gaps 10 and 11 become high impedance and the temperature sensor 6 of the sensor unit 3 ascertains that the road surface temperature has risen above 0° C. because all three inputs of the AND-gate 186 of the device 40 are each supplied with an H-signal, whereby the flip-flop composed of the NOR-gates 189 and 190 is set.

The indicating lamp 185 can also be extinguished when the moisture detecting gaps 10 and 11 are dry, i.e., high impedance, the temperature of the road surface is still below 0° C., and the device 37 simultaneously switches off the heating element 52 of the sensor unit 5 because the timing element 195 of the device 40 is responsive to the trailing edge of the H-signal generated by the device 40 and briefly actuates the AND-gate 187, which is sufficient to set the aforementioned flip-flop of the device 40.

Since the early ice-warning device described above contains means in the form of the control device 36', the device 38, the reversing switch 121, and a Peltier element as the cooling element 54, the sensor unit 4 can be alternately cooled or heated. As a modification, the sensor unit 4 may comprise a heating element 54' (shown in FIG. 3) used for heating the moisture detecting gap 10. In this case, the reversing switch 121 is replaced by a changeover switch which energizes either the Peltier element or the heating element 54'. It is therefore possible to generate the early warning signal as a function of the actual freezing-over of the moisture detecting gap 10, the amount of thawing agent spread or not spread being automatically included in the evaluation. By means of the continuously variable reference voltage, dependent upon the road surface temperature and produced in the device 104, the influence of the thawing agent upon the conductivity of the moisture detecting gaps 9,10, and 11 can be largely eliminated at no great expenditure.

In order to ensure that the values determined by the sensor units 3, 4, and 5 reflect the actual situation, it is advantageous to embed a number of sensor assemblies in the road so that the condition of the road surface is not just monitored at a single location.

What is claimed is:

1. A device for producing an early warning signal in anticipation of ice-formation on a road surface, of the type having ambient temperature sensing means, a first sensor unit comprising surface temperature sensing means and a first moisture detector, a second sensor unit comprising a second moisture detector and means for heating said second moisture detector, a group of comparators respectively connected to said first and second moisture detectors, first signal means for generating said early warning signal, second signal means for generating a signal when said road surface is wet, third signal means for generating a signal when ice has formed on said road surface, and means for actuating and deactuating said means for heating, wherein the improvement comprises:

a third sensor unit comprising a third moisture detector, means for determining the temperature of said third moisture detector, and alternate heating and cooling means;

control means connected to said surface temperature sensing means, to said means for determining the temperature of said third moisture detector, and to the output of said second signal means, said control means being responsive to the difference between the temperature of said road surface and the temperature of said third moisture detector, and responsive to the output of said second signal means to provide electrical power to said alternate heating and cooling means when the road surface is wet;

changeover means responsive to the temperature measured by said means for determining the temperature of said third moisture detector and to values measured by said first, second, and third moisture detectors for changing over the mode of operation of said alternate heating and cooling means to maintain a predetermined temperature difference between the temperature of the road surface and the temperature of said third moisture detector; and a first additional comparator connected to said third moisture detector and a second additional comparator connected to said means for determining the temperature of said third moisture detector, the inputs of said changeover means being connected to the outputs of said group of comparators and of said first and second additional comparators.

2. The device of claim 1, further comprising voltage-producing means for supplying said group of comparators and said first additional comparator with a continuously-variable reference voltage produced as a function of the temperature of said road surface and a measuring amplifier having an input connected to said surface temperature sensing means and an output connected to the input of said voltage-producing means.

3. The device of claim 2, wherein said voltage-producing means comprise a differential amplifier, a diode, and a plurality of resistors, said diode and one of said resistors forming a series connection, said differential amplifier being back-coupled via said series connection, and said diode being reverse-biased across others of said resistors in such a way that said continuously-variable reference voltage drops slowly as the temperature of said road surface falls to about 0° C. and drops more sharply as the temperature of said road surface decreases below 0° C.

4. The device of claim 2, wherein said second additional comparator exhibits a response hysteresis, thereby generating an H-signal at its output when the temperature of said third moisture detector drops to −1° C., and ceasing to generate said H-signal when the temperature of said third moisture detector rises to above +1° C.

5. The device of claim 2, wherein said first signal means is an AND-gate having three inputs, the first of said inputs being connected to the output of said second signal means, the second of said inputs being connected to the output of said first additional comparator, and the third of said inputs being connected to an inverting output of said third signal means.

6. The device of claim 1, wherein said alternate heating and cooling means comprise a Peltier element and a reversing switch responsive to an output signal generated by said changeover means.

7. The device of claim 1, wherein said alternate heating and cooling means comprise a Peltier element and a heating element built into said third sensor unit, the energy supplied by said control means being fed to said Peltier element for cooling said third sensor unit or to said heating element for heating said third sensor unit.

8. The device of claim 1, further comprising a plurality of resistors and a power source for applying an operating voltage to said moisture detectors, wherein said power source comprises at least one multivibrator producing positive and negative pulses and supplying each said moisture detector across a respective one of said resistors.

9. The device of claim 1, wherein said control means comprise first means for generating a signal as a function of the difference between the temperature of said road surface and the temperature of said third moisture detector, second means for delivering an adjustable reference voltage, and third means for generating an output signal when said signal generated by said first means reaches said adjustable reference voltage.

* * * * *

UNITED STATES PATENT AND TRADEMARK OFFICE

CERTIFICATE OF CORRECTION

PATENT NO. : 4,222,044

DATED : September 9, 1980

INVENTOR(S) : Marcel Boschung

It is certified that error appears in the above-identified patent and that said Letters Patent are hereby corrected as shown below:

Column 7, line 10, "100" should be --110--;
line 12, "100" should be --110--;

Column 8, line 41, "terminal" should be --terminals--

Signed and Sealed this

*Twelfth* Day of *May 1981*

[SEAL]

*Attest:*

RENE D. TEGTMEYER

*Attesting Officer*

*Acting Commissioner of Patents and Trademarks*